US005690874A

United States Patent [19]

Bell et al.

[11] Patent Number: 5,690,874

[45] Date of Patent: Nov. 25, 1997

[54] FIBER PRODUCTION PROCESS

[75] Inventors: Kathryn Diana Bell, Coventry; Ian Graveson, Nuneaton; Timothy John Ollerenshaw, Towcester, all of United Kingdom

[73] Assignee: Courtaulds Fibres (Holdings) Limited, United Kingdom

[21] Appl. No.: 549,742

[22] PCT Filed: May 4, 1994

[86] PCT No.: PCT/GB94/00956

§ 371 Date: Nov. 7, 1995

§ 102(e) Date: Nov. 7, 1995

[87] PCT Pub. No.: WO94/26962

PCT Pub. Date: Nov. 24, 1994

[30] Foreign Application Priority Data

May 11, 1993 [GB] United Kingdom ..... 9309617

[51] Int. Cl.[6] ..... D01F 2/00; D01F 11/02; D06M 13/285

[52] U.S. Cl. ..... 264/129; 106/18.14; 106/200.3; 264/143; 264/203; 264/211.14; 427/343; 427/372.2; 427/434.6

[58] Field of Search ..... 264/129, 143, 264/187, 203, 211.14; 427/343, 372.2, 434.6; 106/18.14, 200.3

[56] References Cited

U.S. PATENT DOCUMENTS

| | | | |
|---|---|---|---|
| 4,063,883 | 12/1977 | Hupfl et al. | 8/127.1 |
| 4,162,275 | 7/1979 | Moulds | 525/428 |

FOREIGN PATENT DOCUMENTS

| | | |
|---|---|---|
| 451663 | 10/1991 | European Pat. Off. . |
| 2282489 | 3/1976 | France . |
| WO92/07124 | 4/1992 | WIPO . |
| WO03/13249 | 7/1993 | WIPO . |

OTHER PUBLICATIONS

Abstract of U.S.S.R. 1,030,431 (Published Jul. 23, 1983).
Abstract of US Patent No. 3,423,163, issued Jan. 21, 1969.
Abstract of US Patent No. 3,779,861, issued Dec. 18, 1973.
Abstract of US Patent No. 4,503,115, issued Mar. 5, 1985.
Abstract of Canadian Patent No. 1,217,903, issued Feb. 17, 1987.
Abstract of Canadian Patent No. 769,630, issued 1968.
Abstract of European Patent No. 464,136, publ'd Jan. 8, 1992.
Abstract of European Patent No. 146,840, publ'd Jul. 3, 1985.
Abstract of German Patent Appln. No. 3,537,241, publ'd Apr. 23, 1987.
Abstract of French Patent Appln. No. 2,682,385, publ'd Apr. 16, 1993.
Abstract of French Patent Appln. No. 1,572,151, publ'd in 1968.
Abstract of So. African Patent Appln. No. 6,702,114, publ'd Jan. 1968.
Abstract of Japanese Patent Appln. No. 4361667, publ'd Dec. 15, 1992.
Abstract of Japanese Patent Appln. No. 60224819 publ'd Nov. 9, 1985.
Abstract of Japanese Patent Appln. No. 58179635 publ'd Oct. 20, 1983.
Abstract of Japanese Patent Appln. No. 52040325, publ'd Mar. 29, 1977.
Abstract of Japanese Patent Appln. No. 57093133, publ'd Jun. 10, 1982.

(List continued on next page.)

*Primary Examiner*—Leo B. Tentoni
*Attorney, Agent, or Firm*—Howson and Howson

[57] ABSTRACT

A method of forming a flame retardant cellulose fiber is disclosed which comprises the steps of producing lyocell fiber and incorporating a flame retardant chemical into the fiber while the fiber is in the never-dried condition prior to first drying.

10 Claims, 2 Drawing Sheets

OTHER PUBLICATIONS

Abstract of Japanese Patent Appln. No. 56085498 publ'd Jul. 11, 1981.

Abstract of Japanese Patent Appln. No. 56085497 publ'd Jul. 11, 1981.

Abstract of Japanese Patent Appln. No. 55002382 publ'd Jan. 9, 1980.

Abstract of Japanese Patent Appln. No. 53078377, publ'd Jul. 11, 1978.

Abstract of Japanese Patent Appln. No. 75028421 publ'd Sep. 16, 1975.

Abstract of Japanese Patent Appln. No. 72029049 publ'd Aug. 1972.

Abstract of Japanese Patent Appln. No. 69025400, publ'd in 1968.

Abstract of Japanese Patent Appln. No. 68016678, publ'd in 1968.

FIBER PRODUCTION PROCESS

BACKGROUND OF THE INVENTION

1. Field of the Invention

This invention relates to methods of producing fibre and has particular reference to methods of producing fibre having inherent flame retardancy properties.

2. Description of the Related Art

As used herein, the term "lyocell" is defined in accordance with the definition agreed by the Bureau International pour la Standardisation de la Rayonne et de Fibres Synthetique (BISFA) namely:

"A cellulose fibre obtained by an organic solvent spinning process; it being understood that:

(1) an "organic solvent" means essentially a mixture of organic chemicals and water; and (2) "solvent spinning" means dissolving and spinning without the formation of a derivative".

As used herein, by a "flame retardancy chemical" is meant one which retards the burning of a product to which it is applied.

SUMMARY OF THE INVENTION

The present invention provides a method of producing a flame retardant lyocell fibre which comprises the steps of:

(i) forming a solution of cellulose in an organic solvent, (ii) extruding the solution through a spinnerette downwardly into an air gap to form a plurality of strands, (iii) passing the thusly formed strands downwardly through a water-containing spin bath, (iv) leaching the solvent from the thusly formed strands to produce filaments of cellulose, (v) incorporating into the filaments of cellulose, whilst still wet, a flame retardant chemical, and (vi) fixing the chemical onto the cellulose to produce a cellulose filamentary material having inherent flame retardancy.

The present invention further provides a method of forming a flame retardant cellulose fibre comprising the steps of producing lyocell fibre and incorporating a flame retardant chemical into the fibre whilst the fibre is in the never-dried condition (i.e. prior to first drying).

The flame retardant chemical may be a phosphorous based chemical and may be a quaternary phosphonium compound. The flame retardant chemical may be tetrakis (hydroxymethyl) phosphonium salt.

The flame retardant chemical may be fixed by a curing process utilising the action of ammonia or heat. The flame retardant chemical is preferably applied to never-dried lyocell fibre in tow form. The tow may be cut into staple fibre prior to drying for the first time or after drying.

The tow having the flame retardant chemical or chemicals fixed thereon may be dried as tow, crimped and cut to form staple fibre. The tow may be provided with a finish, a chemical compound added to the tow to enhance or ease the processing of fibre during subsequent operations. The fixing of the flame retardant chemical to the cellulose may be carried out during the drying of the cellulose, or may be carried out as a separate step prior to the drying of the cellulose. Alternatively, the cellulose may be dried and then passed through a fixing process finally to fix the flame retardant chemical to the cellulose.

BRIEF DESCRIPTION OF THE DRAWINGS

By way of example the present invention will now be described with reference to the accompanying drawings.

DETAILED DESCRIPTION OF PREFERRED EMBODIMENTS

The production of lyocell fibre is described in U.S. Pat. No. 4,416,698, the contents of which are incorporated herein by way of reference. Lyocell fibre may be produced by any known manner. The invention is solely concerned with the production of a flame retardant lyocell fibre.

DESCRIPTION OF PREFERRED EMBODIMENTS

In a preferred process for the production of lyocell fibre, a solution of cellulose in an organic solvent, typically N-methyl morpholine N-oxide is formed by heating N-methyl morpholine N-oxide, water and cellulose to evaporate the water so as to form the solution. The solution may contain a suitable stabiliser. The solution is commonly referred to as a spinning dope. This dope is then forced through a spinnerette jet to pass in filamentary form as strands through an air gap into a spin bath. The spin bath contains water and leaches the solvent from the strands. During the leaching process the cellulose component of the solution re-forms to produce the cellulosic filamentary material. The filamentary material is in the form of a bundle of filaments, commonly referred to as a tow. The tow comprises essentially a plurality of parallel filaments, the number of filaments in the tow being equal to the number of strands produced by the spinnerette jet.

The tow of fibre having been produced by the leaching process is referred to as never-dried fibre, in the sense that the tow is still wet and has not been dried at that stage in its processing life. Never-dried fibre has slightly different physical characteristics to fibre which has been dried and is subsequently rewetted. Typically never-dried fibre contains a greater proportion of water than can be incorporated into dried fibre merely by wetting it.

One type of flame retardant treatment is the PROBAN precondensate treatment using tetrakis (hydroxymethyl) phosphonium (THP) available from Albright & Wilson Ltd., England.

Figure 1:
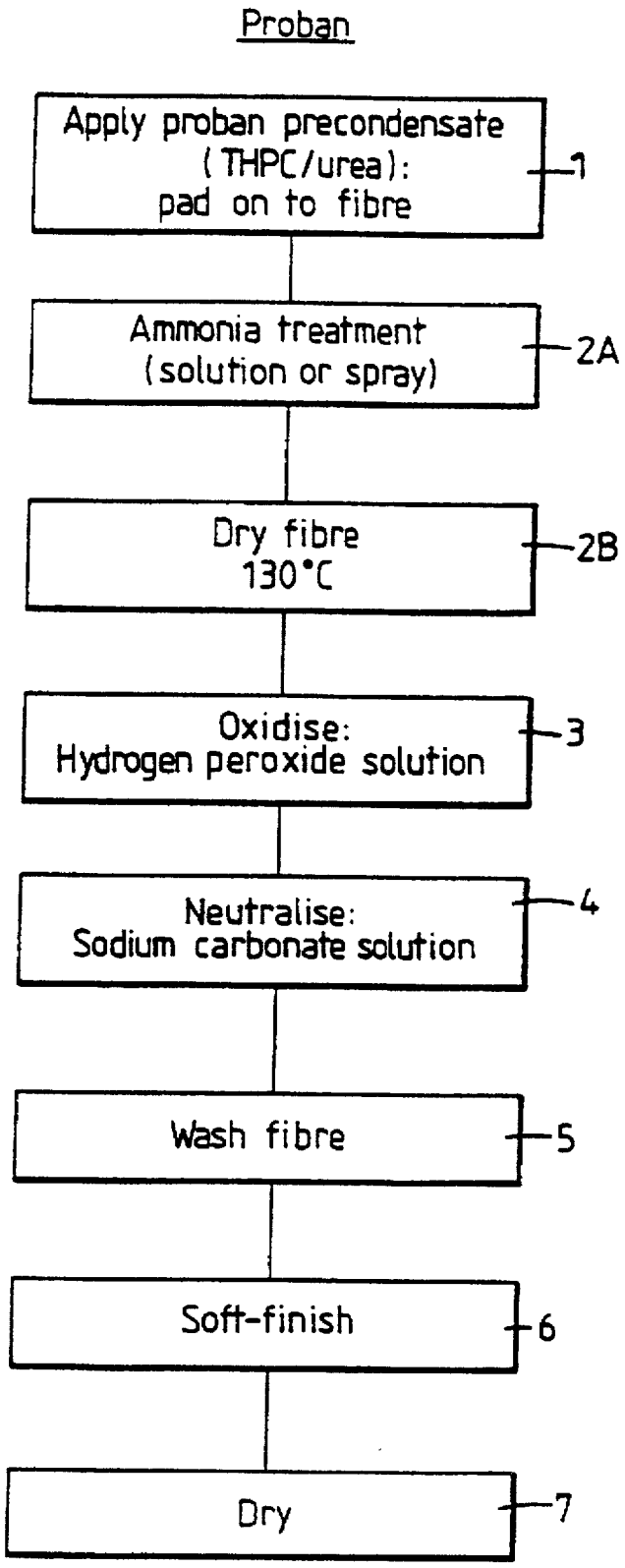
FIG. 1 shows schematically an application route for the application of flame retardant (FR) PROBAN precondensate chemicals to fibre.

The never-dried fibre is then treated to give it a PROBAN precondensate finish in accordance with the sequence illustrated in FIG. 1. The fibre is first passed through a bath containing PROBAN pre-condensate namely a mixture of tetrakis (hydroxymethyl) phosphonium and urea. The fibre emerging from the bath is then passed through the nip of a pair of rollers to remove excess pre-condensate. This is the process illustrated by block 1 in FIG. 1. The fibre is then passed through an ammonia solution or has ammonia sprayed onto it in box 2A. The thus treated fibre is then dried at 130° C. in a suitable drying equipment such as a drying tunnel or by being passed over heated drying rollers. The drying, at a temperature of 130° C. occurs in block 2B. In an alternative form of curing process, blocks 2A and 2B are replaced in their entirety by a heat cure step which occurs at 120°–170° C.

After the precondensate has been applied and cured onto the fibre it is oxidised as at block 3 using, for example, hydrogen peroxide solution.

The oxidised coating is then neutralised as at block 4 with, for example, a solution of sodium carbonate.

Subsequently the fibre is washed as at block 5 and is then passed through a soft finish roller as at block 6 prior to drying as at block 7.

The solutions of hydrogen peroxide, sodium carbonate or similar and soft finish can be applied either by dipping the fibre through the solution or by spraying a solution onto the fibre or by an other suitable means. Typically the fibre is washed by plating the fibre onto a porous support such as a steel mesh and then washing with demineralised water. The fibre is dried by suitable dryers such as drum dryers.

Figure 2:
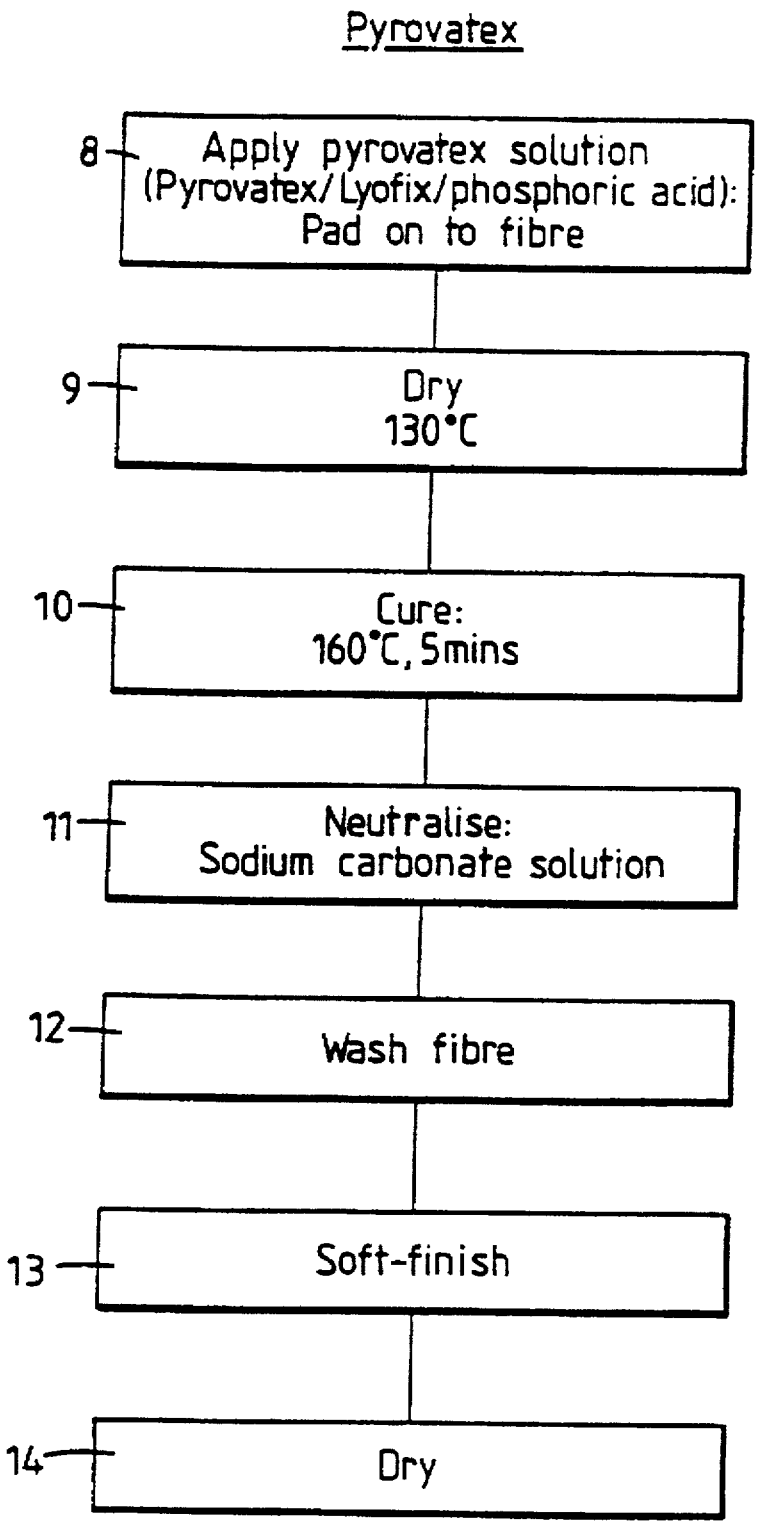
FIG. 2 shows schematically an application route for the application of FR PYROVATEX chemicals to fibre.

In an alternative process, PYROVATEX solution may be applied to the never-dried fibre. This process is illustrated in block form in FIG. 2. In this case the PYROVATEX solution is applied to the fibre at 8 by dipping the fibre in PYROVATEX solution, a fixing resin such as LYOFIX Resin and phosphoric acid. Subsequently the excess solution on the fibre is removed by passing the fibre through the nip of a pair of rolls. The fibre is then dried at 130° C. at 9 and cured in a separate curing oven at 160° C. for 5 minutes as shown at block 10. Subsequently the fibre is treated with sodium carbonate solution to neutralise the fibre as at block 11, washed as at block 12, has a soft finish applied to it as at block 13 and is then dried as at block 14. The solutions and drying processes described in connection with FIG. 2 would effectively be the same as those used in connection with the processed illustrated in connection with FIG. 1.

Once the never-dried fibre has been treated with THP or other treatment and cured it can then be dried in a conventional manner. The fibre is preferably washed prior to drying to remove excess THP from the fibre. The fibre can be dried either in tow form and utilised as tow, or it can be dried in tow form and subsequently cut to staple. Optionally the fibre may be crimped after drying by means of a mechanical crimping process, and then cut to form staple.

Alternatively, the fibre after curing may be cut to form staple, washed and dried as staple.

The flame retardant chemical may be applied to the fibre in staple form rather than in tow form. Thus after the leaching operation the fibre can be cut to form staple, washed, and the flame retardant chemical can then be applied to the staple. The staple can then be cured, washed and dried as staple. It is preferred, however, that the FR chemical be applied to the fibre in tow form because it is found that there is less entangling of the fibre and the tow treated fibre may be more readily carded to produce an open structure suitable for spinning. The treated fibre can then be processed in a conventional manner to produce fabric. In the case of filamentary material the filament would be wound up and converted by weaving or knitting or non-woven methods to produce a fabric. In the case of staple fibre, the fibre would be carded, spun and the yarn produced by spinning could be woven or knitted to produce a suitable fabric. The fabric may be dyed either after production or it may be dyed as yarn to produce a coloured yarn for the production of fabric.

Rather than using THP or other phosphorous-based compounds—typically quaternary phosphorous—based compounds, nitrogen-based compounds can be used or any other suitable flame retardant.

By incorporating the flame retardant chemical into the fibre in the never-dried state, it is possible to produce fibre which is inherently flame retardant when tested in accordance with British Standard 5867 and which produces fabrics having very good flame retardancy properties. The fibre can be treated on-line under controlled conditions and the customer need not carry out any subsequent flame retardancy treatment to have a flame retardant fabric. It is believed that never-dried fibre picks up about 75% by weight of the active phosphorous containing ingredient compared to a pick-up of about 30% by weight for dried fibre.

In a test, two samples of lyocell fibre were produced, one was dried and treated with 50% (by weight) PROBAN pre-condensate followed immediately by padding with a soft finish, CROSOFT XME finish at 20 g/l. The treated fibre was then dried at 70° C., cured in ammonia gas at ambient temperature, oxidised with hydrogen peroxide solution, neutralised with sodium carbonate, washed and dried. The other sample was given the same treatment, but the treatment was applied to lyocell fibre which had never been dried before the PROBAN precondensate and CROSOFT XME finish were applied.

The following results were obtained as set out in Table 1:

TABLE 1

| | Never Dried | Dried |
|---|---|---|
| 1. Tensiles | | |
| Tenacity (cN/tex) | 34.05 | 30.64 |
| Extension (%) | 9.070 | 7.56 |
| Dtex | 2.129 | 2.20 |
| 2. Flame Retardancy | | |
| % LOI | 31 | 28 |
| % Phosphorus (V) | 4.15 | 2.46 |
| % Phosphorus (III) | 1.0 | 0.5 |
| % Nitrogen | 3.99 | 2.27 |
| Formaldehyde (ppm) | 170 | 180 |
| 3. Additive Pick Up/Distribution | | |
| Dry pick up (g/g) | 0.45 | 0.28 |

It can be seen, therefore, that the application of the PROBAN precondensate treatment to the never dried fibre not only significantly increases the LOI compared to the application to dried fibre, but that this is also accompanied by better tensile properties.

It can be seen that the phosphorus pick up in the never dried fibre is higher than in the dried fibre, and this is confirmed by elemental map micrographs. Comparing the elemental phosphorous maps across the individual fibres by means of line scans shows that there is a concentration of phosphorus in the skin of the dried fibre treated with Proban, whereas the fibre treated in the never dried condition shows a much more even distribution across the fibre.

We claim:

1. A method of forming a flame retardant cellulose fibre comprising the steps of producing lyocell fibre and incorporating a flame retardant chemical into the fibre whilst the fibre is in the never-dried condition prior to first drying.

2. A method as claimed in claim 1 in which said method includes the steps of:

(i) forming a solution of cellulose in an organic solvent, (ii) extruding the solution through a spinnerette downwardly into an air gap to form a plurality of strands, (iii) passing the thusly formed strands downwardly through a water-containing spin bath, (iv) leaching the solvent from the thusly formed strands to produce filaments of cellulose, (v) incorporating into the filaments of cellulose, whilst still wet, a flame retardant chemical, and (vi) fixing the chemical onto the cellulose to produce a cellulose filamentary material having inherent flame retardancy.

3. A method as claimed in claim 1, in which the flame retardant chemical is a phosphorus based compound.

4. A method as claimed in claim 3, in which the flame retardant chemical is a quaternary phosphonium compound.

5. A method as claimed in claim 4, in which the flame retardant chemical is a tetrakis (hydroxymethyl) phosphonium salt.

6. A method as claimed in claim 4 in which the flame retardant chemical is fixed by a curing process utilising the action of ammonia or heat.

7. A method as claimed in claim 1, in which the flame retardant chemical is applied to the fibre in tow form.

8. A method as claimed in claim 7, in which the tow is cut into staple fibre prior to drying for the first time, or after drying.

9. A method as claimed in claim 1, in which the flame retardant chemical is fixed to the cellulose prior to, during, or after drying.

10. Cellulose fibre produced by the method of claim 1.

* * * * *